US005373999A

United States Patent [19]

Miyanami

[11] Patent Number: 5,373,999

[45] Date of Patent: Dec. 20, 1994

[54] GRINDING AND MIXING DEVICE

[75] Inventor: Kei Miyanami, Osaka, Japan

[73] Assignee: Tokuju Corporation, Tokyo, Japan

[21] Appl. No.: 161,400

[22] Filed: Dec. 6, 1993

[30] Foreign Application Priority Data

Feb. 8, 1993 [JP] Japan ..... 5-043283

[51] Int. Cl.[5] ..... B02C 13/02

[52] U.S. Cl. ..... 241/228; 241/229

[58] Field of Search ..... 241/228, 229, 278.1, 241/278.2

[56] References Cited

U.S. PATENT DOCUMENTS

| | | | |
|---|---|---|---|
| 616,728 | 12/1898 | Priest | 241/228 |
| 2,642,231 | 6/1953 | Illig | 241/278.2 |
| 3,596,841 | 8/1971 | Perry | 241/38 |
| 3,889,889 | 6/1975 | Sawa | 241/228 |

FOREIGN PATENT DOCUMENTS

| | | | |
|---|---|---|---|
| 2812958 | 10/1978 | Germany | 241/229 |

*Primary Examiner*—Mark Rosenbaum
*Assistant Examiner*—John M. Husar
*Attorney, Agent, or Firm*—Oblon, Spivak, McClelland, Maier & Neustadt

[57] ABSTRACT

A rotary tank supported by a bearing stand on a horizontal shaft in a freely rotatable manner to form a grinding/mixing chamber having an inner wall of modified cross-section such as oval one at the horizontal center axis position is driven by a rotary drive motor for driving said rotary tank to rotate it adjustably at any relatively low speed in a certain direction. A grinding/mixing blade is inserted into said grinding/mixing chamber over its whole length and mounted at the coaxial position on the rotary shaft other than that for the rotary tank. The grinding/mixing blade has a cross-section in which its long diameter portion is shorter than the short diameter portion of said grinding/mixing chamber, and is driven by a rotary drive motor for driving said grinding/mixing blade to rotate it adjustably at any speed in normal or reverse direction to grind and mix the bulk materials charged into said grinding/mixing chamber by relative rotating motions of rotary tank and grinding/mixing blade and also to perform coating, granulation and dispersion by these actions.

4 Claims, 4 Drawing Sheets

GRINDING AND MIXING DEVICE

FIELD OF THE INVENTION

The present invention relates to a grinding and mixing device capable of peforming regular mixing upon mixing of several kinds of fine particles.

For grinding, mixing, coating or dispersion of bulk materials (powder and particles), the grinding and mixing device as shown, for example, in FIG. 6 has been conventionally used. Namely, the conventional device comprises grinding tank 50 rotating at a high speed in the direction of arrow A, crescent-shaped inner piece 51 held so as to make a small gap G with the inner wall of said grinding tank 50 and driven to rotate with some delay in the same direction (arrow B) as said grinding tank 50, and grinding/mixing chamber 52 in which bulk materials a are received for processing.

The bulk materials a received in grinding/mixing chamber 52 are pushed, under the influence of strong centrifugal force, against the inner wall of grinding-/mixing chamber 52 because grinding tank 50 is rotating at a high speed in the direction of arrow B. The bulk materials a pushed against the inner wall are pushed by inner piece 51 into small gap G and are then compressed further and subjected to strong shearing force, thus leading to the formation of fine powders from the particle surface.

According to the grinding and mixing device of said structure, however, the materials become stuck to the inner wall of grinding/mixing chamber 52 and form a lining so as to cause almost no fluidization in the thickness direction because grinding tank 50 is rotating at a high speed. For this reason, though fine powders are formed by shearing and friction on the surface where inner piece 51 slides, almost no powder is formed in the vicinity of the inner wall of grinding/mixing chamber 52, thus requiring it much time to achieve complete uniformity of products as a whole.

Furthermore, the conventional device of said structure has the disadvantage that since inner piece 51 is always in sliding contact with the bulk materials a under strong pressure, said inner piece 51 becomes higher in temperature due to friction, which causes thermal deterioration of bulk materials.

SUMMARY OF THE INVENTION

The present invention has been made with a view to solving the foregoing problems, and the object of this invention is to provide a grinding and mixing device capable of grinding and mixing bulk materials in a short time with no thermal influence exerted on the bulk materials and achieving not only mere mixing, but also regular mixing condition, thus making it possible to form functional composite particles.

The grinding and mixing device in accordance with the present invention comprises a rotary tank supported by a bearing stand on a horizontal shaft in a freely rotatable manner to form a grinding/mixing chamber having an inner wall of modified cross-section (oval, for example) at the horizontal center axis position, a griding-/mixing blade of modified cross-section inserted into said grinding/mixing chamber over its whole length, mounted at the coaxial position on the rotary shaft other than that for the rotary tank and having a cross-section in which its long diameter portion is shorter than the short diameter portion of said grinding/mixing chamber, a rotary drive motor for driving said rotary tank to rotate it adjustably at any relatively low speed in a certain direction, and a rotary drive motor for driving said grinding/mixing blade to rotate it adjustably at any speed in normal or reverse direction. The device of the present invention serves mainly to grind and mix the bulk materials charged into said grinding/mixing chamber by relative rotating motions of rotary tank and grinding/mixing blade and also to perform coating, granulation and dispersion by these actions. Moreover, these operations can be performed regardless of whether the modified cross-section of the grinding/mixing chamber and that of the grinding/mixing blade in said rotary tank have the same shape.

When the rotary tank is rotated at such a speed as to ensure that said bulk materials do not stick by centrifugal force to the inner wall after they have been imparted into the tank, the materials drop freely by gravitation and fluidize along the inner wall of grinding/mixing chamber. At this time, if the grinding/mixing blade and rotary tank are displaced by relative rotation, the bulk materials imparted between the inner wall of modified cross-section and the front side on the periphery of grinding/mixing blade are pressed instantaneously into the small gap, thus generating a strong shearing force. And, by repeated application of this shearing force, the fine particle surfaces are further ground between the inner wall and the periphery of grinding/mixing blade, thus producing finer particles.

Further, the bulk materials ground to finer particles are subjected to repeated mixing during their fluidization along the inner wall of modified cross-section along with the rotation of the rotary tank, thus assuring regular mixing where particles are mixed very uniformly. On the other hand, since regular mixing is performed together with a strong shearing stress when the materials pass through the small gap instantaneously, it is also possible to embed different fine particles regularly in the peripheral surface of fine particle, thus forming functional composite particles having a novel characteristic.

Moreover, since the grinding/mixing blade serves to generate a strong shearing force at the time when its long diameter portion crosses the short diameter portion of the grinding/mixing chamber during said grinding/mixing operation to form a small gap, there is little or no internal temperature rise during this grinding-/mixing operation, thus causing little or no thermal influence on the bulk materials.

As has been described above, the grinding and mixing device according to the present invention is capable of grinding and mixing bulk materials in a short time with no thermal influence exerted on the bulk materials and achieving not only mere mixing, but also regular mixing condition, thus making it possible to form functional composite particles, because it is of such structure that instantaneuous shearing force may be applied repeatedly on the bulk materials being fluidized in the griding-/mixing chamber by gravity fall caused by the grinding-/mixing chamber and the grinding/mixing blade each having modified cross-sections. Therefore, a very noticeable effect can be obtained by putting this invention into practice.

DETAILED DESCRIPTION OF THE PREFERRED EMBODIMENT

Figure 1:
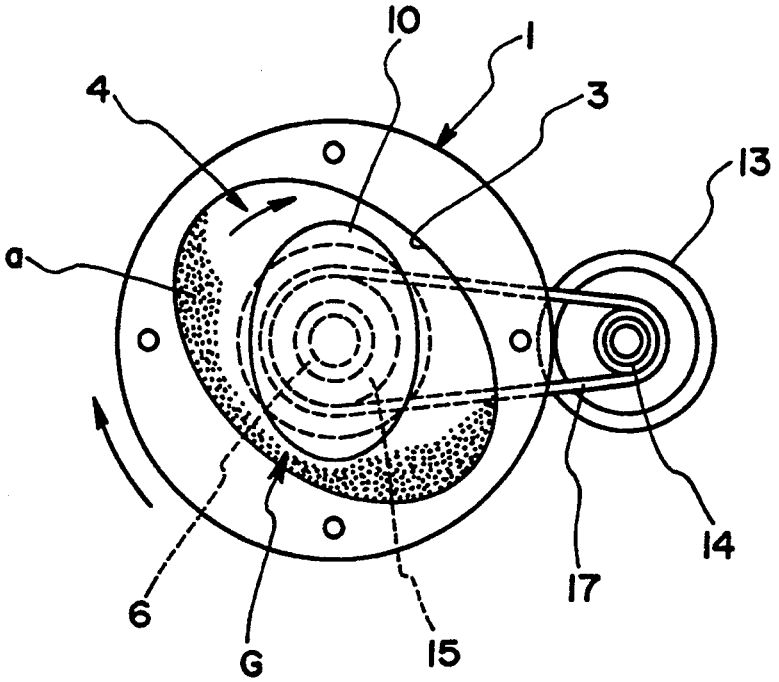
FIG. 1 is a front view of the grinding and mixing device with its end panel removed, showing one embodiment of this invention.
Figure 2:
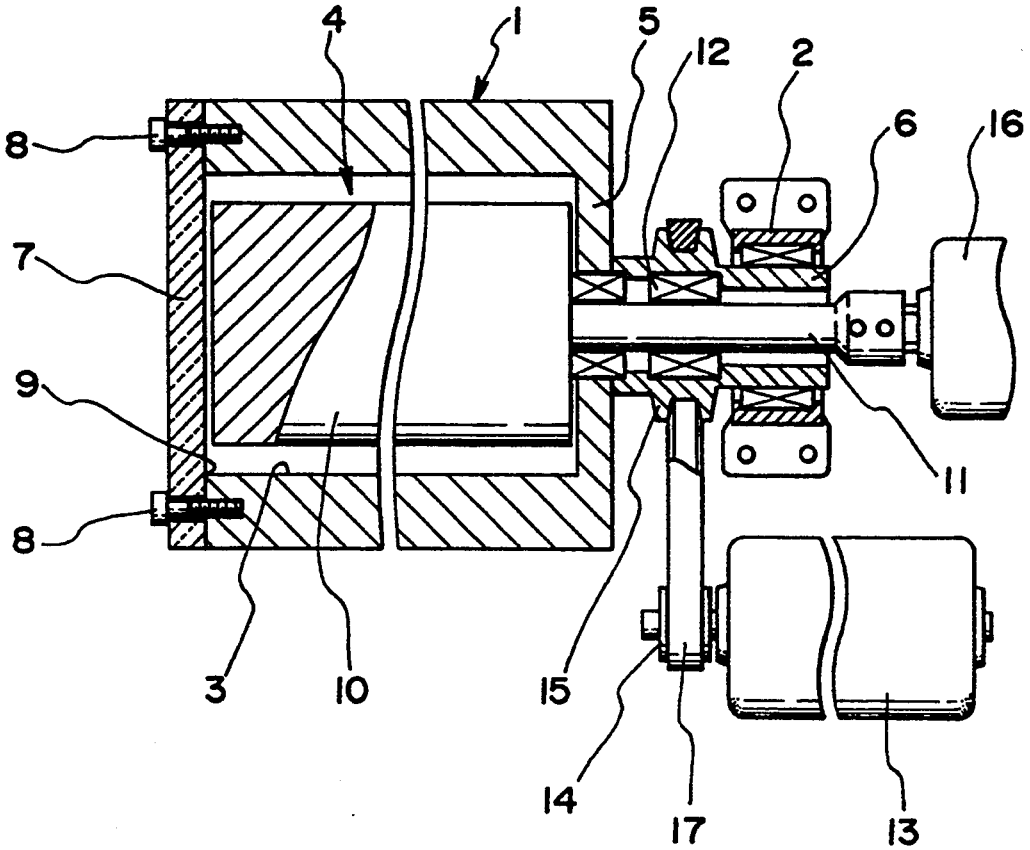
FIG. 2 is a top view of the same item as in FIG. 1.

In the following, one embodiment of the grinding and mixing device in accordance with this invention is described with reference to FIGS. 1 through 3.

Numeral 1 denotes an end view of a cylindrical rotary tank supported in a freely rotatable manner by a bearing stand 2 fixed on the base (not shown) at horizontal rotary cylinder shaft 6 which protrudes from tank bottom 5 on the horizontal center axis. At the horizontal center axis position, grinding/mixing chamber 4 having inner wall 3 of oval cross-section is formed.

At the open end of said rotary tank 1, disk-shaped end panel 7 made of transparent material permitting visual inspection of the inside of the tank is detachably mounted by locking bolts 8, 8 to form material charge/-discharge opening 9.

Numeral 10 denotes a grinding/mixing blade inserted into said grinding/mixing chamber 4 over its whole length to form a columnar body of oval cross-section. Long diameter portion L2 of said grinding/mixing blade 10 is shorter than short diameter portion L1 of grinding/mixing chamber 4 (L1>L2). Rotary shaft 11 protruding from one end of the shaft center is inserted through bearing 12 into said rotary cylinder shaft 6 to form a minimum gap G with inner wall 3 of rotary tank 1.

Numeral 13 denotes a rotary drive motor for driving said rotary tank by the input from a controller to rotate it adjustably at any relatively low speed in a certain direction. This motor is connected to said rotary tank 1 by an endless belt stretched between belt pulley 14 attached to the output shaft of said motor and belt pulley 15 formed on rotary cylinder shaft 6 integral with said rotary tank 1 to rotate said rotary tank 1.

Numeral 16 denotes a rotary drive motor for driving said grinding/mixing blade by the input from a controller to rotate it adjustably at any speed in normal or reverse direction. The output shaft of said motor is connected to rotary shaft 11 protruding from one end of said grinding/mixing blade 10 to rotate said grinding-/mixing blade 10.

The grinding and mixing device of said structure serves to perform grinding and mixing operations after bulk materials a have been placed into grinding/mixing chamber 4 with end panel 7 removed and the rotating direction and speed of rotary drive motor 13 for the rotary tank and rotary drive motor 16 for the grinding-/mixing blade have been determined by adjusting the controller. This device serves to grind and mix the bulk materials a by relative rotating motions of rotary tank 1 and grinding/mixing blade 10 to be driven by two motors 13, 16 and also to perform coating, granulation and dispersion by these actions.

In this embodiment, a batch processing system where end panel 7 is removed for placing said bulk materials a into grinding/mixing chamber 4 is only described. However, it is needless to say that a continuous processing system can be realized by extending the device in the axial direction so as to ensure that a processing time may be secured and that the bulk materials a charged from one end of grinding/mixing chamber 4 may be discharged from other end.

Moreover, while the grinding and mixing device is supported horizontally on the base according to the embodiment shown in the figures, it becomes easier to charge and discharge the bulk materials a if said base is installed on a tilting device so that the rotary shaft may be inclined to open the charge/discharge opening 9 of rotary tank 1 upwardly.

Figure 3:
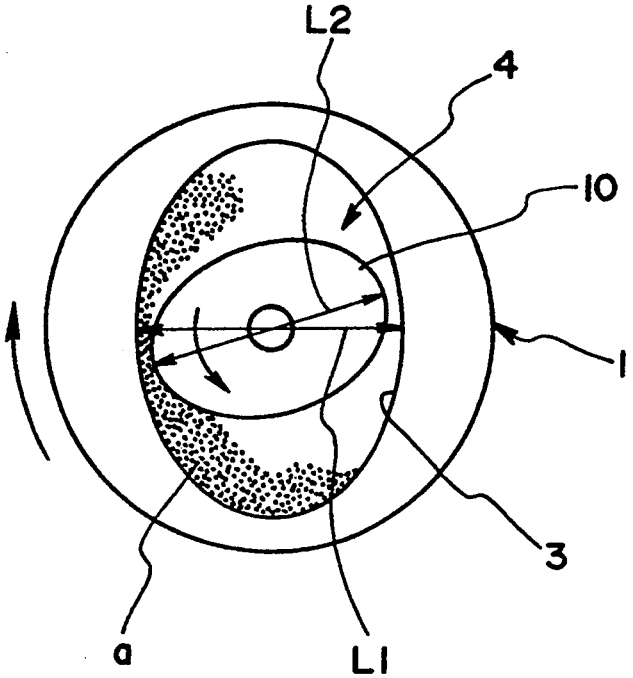
FIG. 3 (*a*) and (*b*) are explanatory drawings showing the example of relative displacement of rotary tank and grinding/mixing blade, respectively.
Figure 3B:
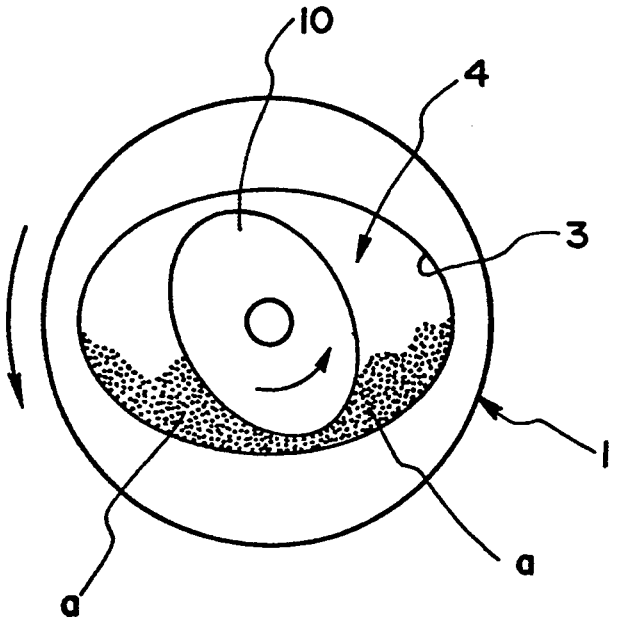

When rotary tank 1 is rotated at such speed as to ensure that said bulk materials a do not stick by centrifugal force to inner wall 6 after they have been placed into the tank, the materials drop freely by gravitation and fluidize along the inner wall 6 of grinding/mixing chamber 4 as is shown in FIG. 3. At this time, if grinding-/mixing blade 10 is rotated in the direction opposite to (see FIG. 3 (*a*)) or same as (see FIG. 3 (*b*)) that of rotary tank 1 to cause relative displacement thereof, the bulk materials between the inner wall 3 of oval cross-section and the front side on the periphery of grinding/mixing blade 10 are pressed instantaneously into the small gap G, thus generating a strong shearing force. And, by repeated application of this shearing force, the fine particle surfaces are further ground between inner wall 3 and the periphery of grinding/mixing blade 10, thus producing finer particles.

Figure 4:
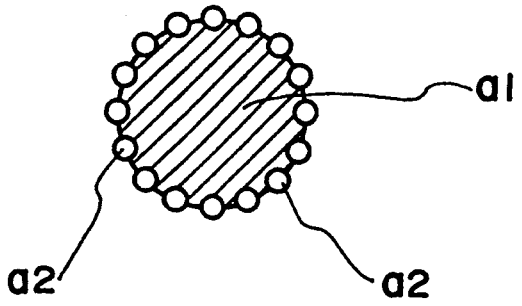
FIG. 4 is an enlarged drawing showing one embodiment of functional composite particles.

Further, the bulk materials a ground to finer particles are subjected to repeated mixing during their fluidization along the inner wall 3 of modified cross-section with the rotation of rotary tank 1, thus assuring regular mixing where particles are mixed very uniformly. On the other hand, since regular mixing is performed together with a strong shearing stress when the materials pass through the small gap G instantaneously, it is also possible to embed different fine particles a2, a2 . . . regularly in the peripheral surface of fine particle a1 as shown in FIG. 4, thus forming functional composite particles having a novel characteristic.

Moreover, since grinding/mixing blade 10 senses to generate a strong shearing force at the time when its long diameter portion crosses the short diameter portion of grinding/mixing chamber 4 during said grinding/mixing operation to form a small gap G, there is little or no internal temperature rise during this grinding/mixing operation, thus causing little or no thermal influence on the bulk materials a.

Figure 5:
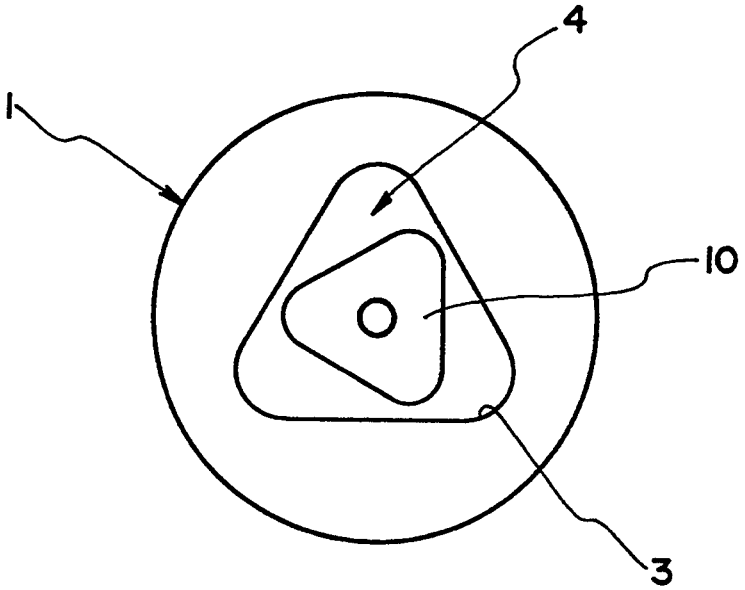
FIG. 5 is a front view showing another embodiment of rotary tank and grinding/mixing blade of modified cross-section.
Figure 6:
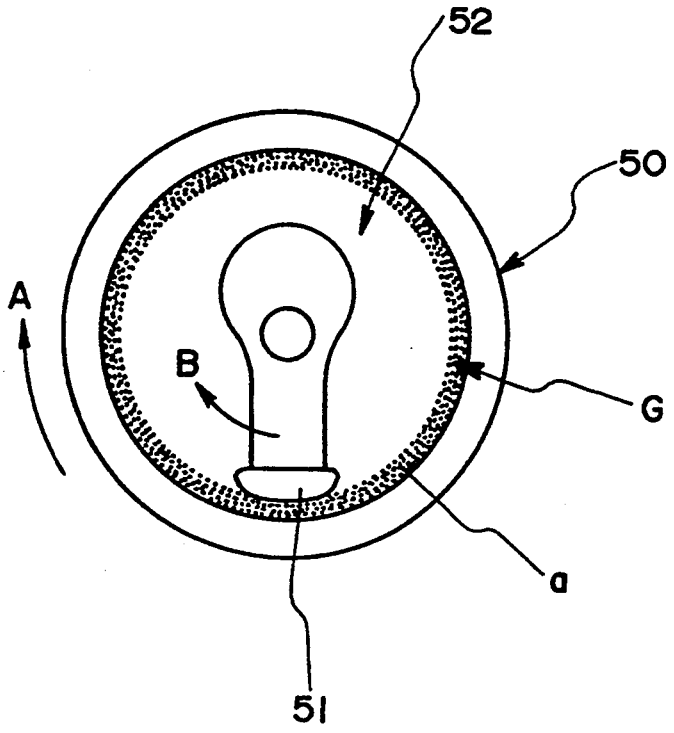
FIG. 6 Prior Art
FIG. 6 is a front view showing the main portion of the conventional grinding and mixing device.

While the grinding and mixing device of this invention has been described with reference to its one embodiment, this invention is characterized by a structure in which the cross-section of inner wall 3 of grinding-/mixing chamber 4 formed in rotary tank 1 and that of grinding/mixing blade 10 are modified so as to make a small gap G therebetween discontinuously. It is a matter of course that a similar effect can be obtained by making the cross-section of inner wall 3 of grinding-/mixing chamber 4 and that of grinding/mixing blade not only to be oval, but also to be oblong or triangular with rounded comers as shown in FIG. 5. Moreover, the cross-section of inner wall 3 of grinding/mixing chamber 4 and that of grinding/mixing blade 10 are not limited only to a similar shape, but may be dissimilar in shape such as a combination of oval and triangular ones.

What is claimed is:

1. A grinding and mixing device comprising:

a rotary tank having an inner wall of oval cross-section at the horizontal center axis portion and supported by a bearing stand on a horizontal shaft in a freely rotatable manner to form a grinding/mixing chamber;

a grinding/mixing blade of oval cross-section inserted into said grinding/mixing chamber over its whole length, mounted at the coaxial position on the rotary shaft other than that for the grinding/mixing chamber and having a cross-section in which its long diameter portion is shorter than the short diameter portion of the grinding/mixing chamber;

a rotary drive motor for driving said rotary tank to rotate said tank adjustably at a first given speed which is a relatively low speed in a certain direction; and a rotary drive motor for driving said grinding/mixing blade to rotate said blade adjustably at a second given speed in a normal or reverse direction, wherein the device serves to grind and mix bulk materials imparted into said grinding/mixing chamber by relative rotating motions of said rotary tank and said grinding/mixing blade to thereby perform coating, granulation and dispersion.

2. The grinding and mixing device as set forth in claim 1, wherein the modified cross-section of the grinding/mixing chamber of said rotary tank and that of the grinding/mixing blade are oval in shape, respectively.

3. The grinding and mixing device according to claim 1, wherein the oval ratio of the oval cross-section of said grinding/mixing chamber of said rotary tank and that of the grinding/mixing blade are different.

4. The grinding and mixing device according to claim 1, wherein the oval ratio of the oval cross-section of said grinding/mixing chamber of said rotary tank and that of the grinding/mixing blade are equal.

* * * * *